US006449774B1

(12) United States Patent
Michael

(10) Patent No.: US 6,449,774 B1
(45) Date of Patent: Sep. 17, 2002

(54) SELF ADHESIVE PROMOTIONAL STRIPS FOR MARTIAL ARTS BELTS

(76) Inventor: David C. Michael, 5477 Hwy. 11E, Piney Flats, TN (US) 37686

( * ) Notice: Subject to any disclaimer, the term of this patent is extended or adjusted under 35 U.S.C. 154(b) by 0 days.

(21) Appl. No.: 09/858,344

(22) Filed: May 15, 2001

(51) Int. Cl.[7] ..... A41F 9/00
(52) U.S. Cl. ..... 2/311
(58) Field of Search ..... 2/338, 310–318, 2/321, 148; D2/624, 627; 283/61, 62; 428/42.2, 42.3, 43; 482/83, 87–88

(56) References Cited

U.S. PATENT DOCUMENTS 4,328,533 A * 5/1982 Paredes ..... 2/102
5,362,106 A * 11/1994 Longtin ..... 283/109
5,410,761 A * 5/1995 Connelly et al. ..... 2/195.1
5,443,875 A * 8/1995 Liu ..... 2/115
5,539,933 A * 7/1996 Garber et al. ..... 2/311
5,782,494 A * 7/1998 Crandall et al. ..... 281/12
6,039,356 A * 3/2000 Warther et al. ..... 283/61

* cited by examiner

*Primary Examiner*—Gloria M. Hale
*Assistant Examiner*—Tejash Patel

(57) ABSTRACT

Promotional strips for martial arts belts comprised of a thin flexible vinyl sheet material of specifically designed properties and characteristics to easily and attractively mark a uniform belt. The strips are pre-cut and releaseably attached to a carrier sheet. Each strip is coated with a thin film of pressure sensitive adhesive on one side for securely attaching to a belt. A wide variety of colors as well as printable surface are available.

5 Claims, 1 Drawing Sheet

SELF ADHESIVE PROMOTIONAL STRIPS FOR MARTIAL ARTS BELTS

BACKGROUND OF THE INVENTION

1. Field of Invention

This invention concerns unique means for marking or promoting the various rankings of students or other participants of the martial arts and particularly concerns specialized self-adhesive, colored vinyl strips for marking the waist belts worn by such participants.

2. Prior Art

Colored adhesive strips arc commonly used in martial arts training to indicate rank or achievement of the participant. Currently, instructors cut or tear such strips from rolls of colored tape and wrap them on the student's belt, or stick them to something else for later use. The tape material used in such rolls however, is too thin, too stretchable and too deformable to maintain a clean rectangular shape of the tape throughout the cutting/transfer process. Further, the tape glue tends to seep out or become exposed due to shrinkage of the strip, which leave a sticky residue and collects dirt. Also, there are a limited variety of colors available, and those are usually flat, matte, or otherwise have a dull finish.

Some means must also be in place to store and use the various colored rolls or tape. One common method is to install a rack on the wall in the training area where awards will be given to hold the rolls and a pair of scissors or a knife. This makes it possible for the instructor to cut a strip, albeit of non-uniform length, of the appropriate color and immediately place it on the student's belt. However, this can be a safety hazard particularly for children training in that area and also, the steps involved are time consuming which can present a real problem for large classes of participants. One alternative is to store and cut strips in another area in advance, then carry them to the floor to be distributed. Handling the cut strips then becomes a time consuming problem. The strips also can be stuck to something such as a piece of plastic, but they are difficult to remove and unsightly due to variations in size and placement. Some instructors stick the cut strips to their own clothing temporarily to carry then to the floor. Aside from being even more unsightly, the strips pick up dirt and lint and may not stick well when applied.

Regardless of how the strips are transferred, someone must cut each one by hand, and this is both tedious and time consuming, which can be costly in terms of labor and morale. The irregularity of hand cut strips also leads to a costly waste in material. Overall, the current methods and material being used are inefficient and lead to poor quality results.

BRIEF SUMMARY OF THE INVENTION

The invention in one of its principal utility embodiments is defined as a martial arts belt of fibrous construction having an undeformed contour of a generally flat, thin and narrow configuration with a length of at least about three feet, wherein said belt is comprised of multi-layered fabric, which layers are multi-stitched in a longitudinal direction to impart semi-rigidity to said belt, said belt being sufficiently flexible to be tied in a knot, wherein at least one adhesive strip of colored and substantially non-stretchable vinyl material is contact adhesively secured to and generally laterally girdles said belt on the undeformed contour thereof, and wherein end portions of said strip are overlapped and adhesively secured to each other at the overlap.

In on preferred embodiment, the vinyl material has a thickness of from about 2.5 to about 5.0 mils, a width of from about 0.3 to about 0.9 in., and has a "Stretch Modulus" of less than about 0.1 and most preferably of from about 0.01 to about 0.0005. In a most preferred embodiment the strip width is from about 0.4 to about 0.6 in., and the thickness is from about 3.0 to about 4.5 mils.

Our objective was to solve all of the above mentioned problems which has been achieved by a method including employing a heavier and more attractive vinyl, a cleaner acrylic adhesive, pre-cut perfectly sized strips, on silicon coated paper for easy removal and pages of the strips hole punched to fit any available ring binder. The vinyl we use does not stretch or distort easily, making it easier to apply neatly to the student's belt. The adhesive does not seep or squeeze out from under the applied strip, nor will the strip shrink significantly such as to expose glue residue. A wide variety of colors are available with a much more attractive finish, making the present product especially appealing and useful as a reward to participants, especially to children.

The strips are used to indicate completion of certain levels, tasks, or mastery of certain skills in the martial arts. The pages or loose-leaf binders are carried to the floor where each strip can be easily removed from the release liner for use. hey are wrapped around the end of the uniform belt, adhesive backing against the belt, in such a way that the strip ends overlap slightly, e.g., 0.25–0.75 inches, providing a secure but releasable bond therebetween.

The product is mass-produced in a ready to use form which completely eliminates the need for any sharp or bulky objects on the training floor. The labor and waste involved in hand cut strips is eliminated, and any unsightly or inefficient method of storing, carrying, and using the strips is replaced by a neat, clean, easy to use sheet which can be inserted into a binder along with as many different colors as may be needed. The cost is therefor considerably less, and the end result is an efficient, attractive marking system.

DESCRIPTION OF THE INVENTION

Figure 1:
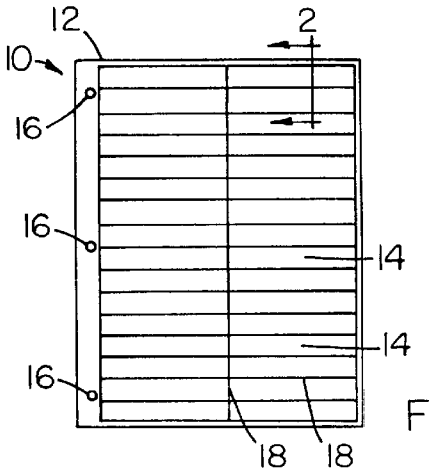
FIG. 1 is a top plan view of a promotional strip page embodying the present invention.

Referring to the drawings, FIG. 1 depicts a first preferred embodiment of the promotional strips assembly or loose-leaf product labeled as item 10. This assembly consists of a release liner 12 with a number of removable, self-adhesive pre-cut strips 14. The release liner is punched in a standard three-ring pattern 16 to facilitate storage and use of multiple pages. The strips 14 are preferably scored along line 18 to divide the vinyl without cutting the release liner.

Figure 2:
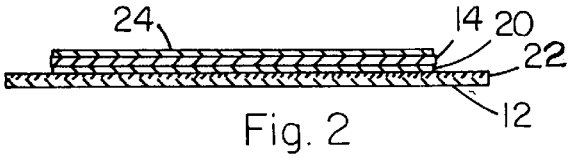
FIG. 2 is an enlarged cross-sectional view along the section line 2—2 of FIG. 1.

FIG. 2 shows the strips 14 in cross section with a pressure sensitive acrylic adhesive coating or backing 20 on one side and releaseably adhered to a thin film of silicon 22 on the paper release liner 12 surface to securely hold the strips until ready for use. The release liner need not be paper or specifically silicon coated as many other products are readily available which would be suitable for this purpose. The vinyl strips 14 can be any of a number of colors readily available from manufacturers such as those mentioned below. The vinyl surface may also be treated as at 24 to be print receptive if text or a logo is desirable in addition to any colored background.

Figure 4:
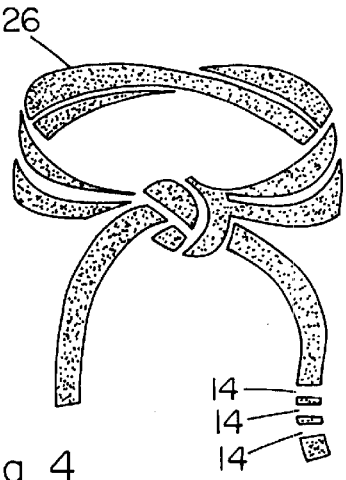
FIG. 4 is a perspective view of a martial arts belt depicting the typical placement of promotional strips thereon.
Figure 5:
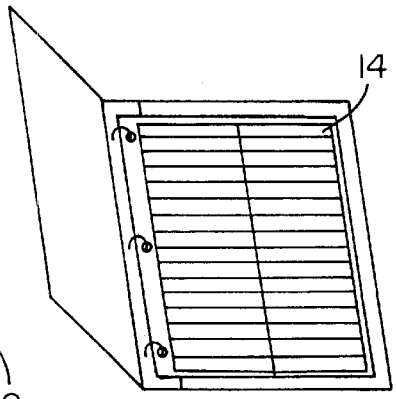
FIG. 5 is a perspective view of a promotional strip page assembly in a typical three ring binder.

In use, one or more strips 14 with adhesive coating 20 thereon are removed from the release liner 12 and wrapped around the end of a student's uniform belt 26 as shown in FIG. 4 with coating 20 against the belt with the ends of the strip overlapped to provide a secure adhesive joint. A key characteristic of the strip 14 arises at this point. As previously described the thickness, Stretch Modulus and other properties and construction of the present strip maintains the rectangular form which allows the user to wrap the strip around the belt and bring the ends into an overlapped adhesively secured condition to provide a neat, clean, straight and attractive marking. The page or pages 10 of strips will typically be inserted into a three-ring binder as depicted in FIG. 5, and carried to the training floor for use during a promotion ceremony.

Figure 3:
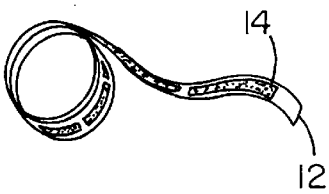
FIG. 3 is a perspective view of a second embodiment of promotional strips for martial arts belts fabricated in a continuous roll configuration.

Another embodiment of this invention is depicted in perspective FIG. 3 in which the individual strips are produced in continuous roll form. The aforementioned basic characteristic of vinyl strips 14, adhesive backing 20, and release liner 12 remain the same. Regardless of the particular size, configuration or composition one may employ to practice the present invention, the intended usefulness and performance of this invention has been demonstrated. Anyone having ordinary skill in the art would be able to obtain the needed material from any of a number of commercial vendors to reproduce the quantities and characteristics of the above described invention.

The present strips are manufactured from calendered vinyl sheet stock with pressure sensitive acrylic adhesive on one side. The stock is commonly available on rolls of coated paper release liner from manufacturers such as FDC or 3M. The strips are produced by feeding the stock through a computer controlled cutting machine that precisely cuts the vinyl without cutting the release liner. Excess vinyl is stripped away leaving on the release liner in economical and utilitarian arrangement only the pre-cut approximately 0.75"×4.5" rectangles. The standard size 3-hole loose-leaf page is then cut from the release liner. The best method we have found for producing this strip product is by a flexographic die-cutting machine capable of processing the rolls of stock into the finished product with very little human attention required.

Figure 6:
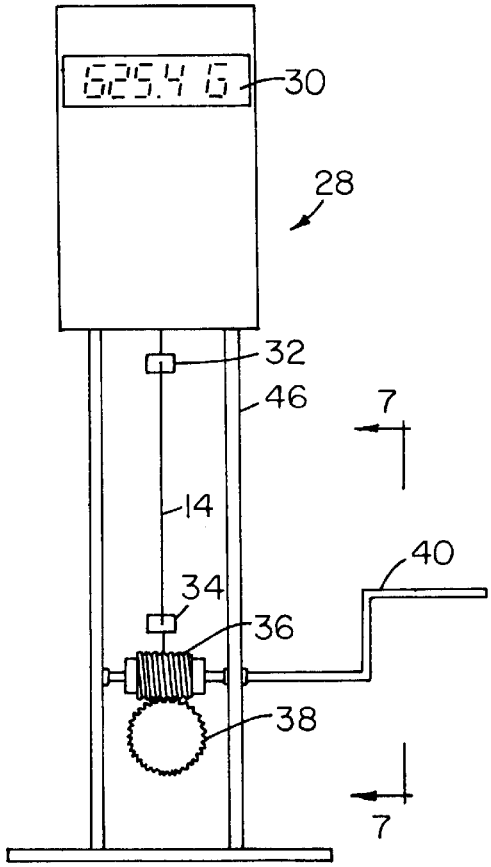
FIG. 6 is a side view of a device for determining the stretch modulus of the present vinyl strip.
Figure 7:
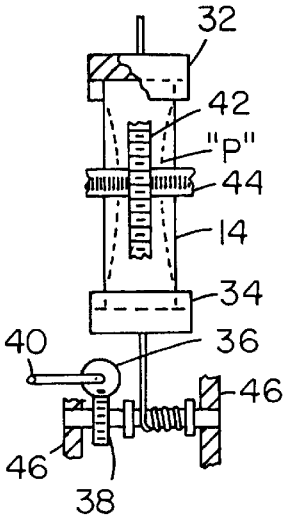
FIG. 7 is a front view of the device of FIG. 6 taken in the direction of the arrow 7.

Referring to FIGS. 6 and 7, the "Stretch Modulus" is determined by a device 28 employing a digital scale for applied distortion force, e.g., 1.0 Kg. This device preferably comprises a digital pull force read out scale 30, clamps 32, 34 for gripping end portions of a strip with adhesive backing 20 thereon, a worm gear 36 and wheel gear 38 and crank 40. A longitudinal (linear) stretch ruler 42 and lateral contraction ruler 44 are mounted on the frame 46 of the device to give real time visual measurements of the degrees of distortion of the strip.

A set of such values is given in the table below:

Stretch Modulus Values

| SAMPLE* | Typical colored tape 3.0 mil | 2.2 mil vinyl tape | 3.5 mil | 4.2 mil |
|---|---|---|---|---|
| Linear distortion | 4% @ 1 kg | 8.5% @ 1 kg | 1% @ 1 kg | 0.2% @ 1 kg |
| Lateral distortion** | 6% @ 1 kg | 16% @ 1 kg | 0.3 @ 1 kg<br>5% @ 3 kg | 0.0% @ 1 kg<br>2.7% @ 3 kg |
| Stretch Modulus*** | .05 | .123 | .007 | .001 |

*All test samples measured 3.85 in., long and 0.85 in., wide.
**3 kg is excessive force but is shown to demonstrate the level at which appreciable distortion occurs with a preferred strips.
***"Stretch Modulus" is defined as the percentage of the average of lateral and linear distortions per applied force. The lateral distortion is measured at the point "P" of maximum lateral contraction.

The foregoing description including the best mode contemplated for carrying out this invention is provided for illustration purposes only and not for the purpose of limitation, the invention being defined by the claims. The invention has thus been described in detail with particular reference to preferred embodiments thereof, but it will be understood that variations and modifications will be effected with the spirit and scope of the invention.

I claim:

1. A martial arts belt of fibrous construction having an undeformed contour of a generally flat, thin and narrow configuration with a length of at least about three feet, wherein said belt is comprised of multi-layered fabric, which layers are multi-stitched in a longitudinal direction to impart semi-rigidity to said belt, said belt being sufficiently flexible to be tied in a knot, wherein at least one adhesive strip having a Stretch Modulus of from about 0.01 to about 0.001, of colored and substantially non-stretchable vinyl material is contact adhesively secured to and generally laterally girdles said belt on the undeformed contour thereof, and wherein end portions of said strip are overlapped and adhesively secured to each other at the overlap.

2. The belt of claim 1 wherein the vinyl material has a thickness of from about 2.5 to about 5.0 mils, a width of from about 0.3 to about 0.9 in., and has a "Stretch Modulus" of from about 0.01 to about 0.0001.

3. The belt of claim 2 wherein said strip is from about 0.4 to about 0.6 in. wide, and from about 3.0 to about 4.5 mil., thick.

4. A martial arts belt of fibrous construction having an undeformed contour of a generally flat, thin and narrow configuration with a length of at least about three feet, wherein said belt is comprised of multi-layered, semi-rigid fabric material, said belt being sufficiently flexible to be tied in a knot, wherein at least one adhesive strip having a Stretch Modulus of from about 0.01 to about 0.001 of colored and substantially non-stretchable vinyl material is contact adhesively secured to and generally laterally girdles said belt on the undeformed contour thereof, wherein said vinyl material has a thickness of from about 2.5 to about 5.0 mils, a width of from about 0.3 to about 0.9 in, and wherein end portions of said strip are overlapped and adhesively secured to each other at the overlap.

5. The belt of claim 4 wherein said strip is from about 0.4 to about 0.6 in wide and from about 3.0 to about 4.5 mil. thick.

* * * * *